US007805788B1

(12) United States Patent
Proctor et al.

(10) Patent No.: US 7,805,788 B1
(45) Date of Patent: Oct. 5, 2010

(54) DEVICE FOR POSITIONING A USER THEREON A BED

(76) Inventors: Melinda Proctor, 465 Stonegate Way, Airdrie, AB (CA) T2B 2Y2; Vernon P. Proctor, 465 Stonegate Way, Airdrie, AB (CA) T2B 2Y2

( * ) Notice: Subject to any disclaimer, the term of this patent is extended or adjusted under 35 U.S.C. 154(b) by 0 days.

(21) Appl. No.: 12/387,832

(22) Filed: May 8, 2009

Related U.S. Application Data

(60) Provisional application No. 61/126,731, filed on May 8, 2008.

(51) Int. Cl.
*A47C 20/02* (2006.01)
*A47C 21/00* (2006.01)

(52) U.S. Cl. ..... 5/648; 5/651; 5/662

(58) Field of Classification Search ..... 5/624, 5/648, 651, 662
See application file for complete search history.

(56) References Cited

U.S. PATENT DOCUMENTS

| | | | | | |
|---|---|---|---|---|---|
| 931,908 | A * | 8/1909 | Weld | ..... | 5/651 |
| 1,539,082 | A * | 5/1925 | Fyler | ..... | 5/651 |
| 3,261,034 | A * | 7/1966 | Bradley | ..... | 5/658 |
| 3,571,828 | A * | 3/1971 | Bergsgaard et al. | ..... | 5/651 |
| 5,119,688 | A | 6/1992 | Snyder, Jr. | | |
| 5,542,312 | A | 8/1996 | Peters | | |
| 5,608,929 | A | 3/1997 | Crane | | |
| 5,611,097 | A * | 3/1997 | Dumke | ..... | 5/651 |
| 6,027,434 | A | 2/2000 | Gibbons | | |
| 6,560,794 | B2 | 5/2003 | Allen et al. | | |
| 6,826,794 | B2 * | 12/2004 | Mahoney et al. | ..... | 5/624 |

FOREIGN PATENT DOCUMENTS

| | | | |
|---|---|---|---|
| GB | 2114880 | A * | 9/1983 |
| GB | 2231492 | A * | 11/1990 |
| WO | WO 9325124 | A1 * | 12/1993 |

* cited by examiner

*Primary Examiner*—Michael Trettel
(74) *Attorney, Agent, or Firm*—Montgomery Patent and Design; Robert C. Montgomery; Joseph T. Yaksich

(57) ABSTRACT

A device to enable a bedridden patient to adjust their position in a bed without additional aid is herein disclosed. The device comprises two (2) "L"-shaped parts connected along a long axis. A first section is placed in between a mattress and footboard, while a second section is laid upon a top of the bed. The overall length would vary to suit individual users of all sizes. A locking handle permits quick adjustments to the length. A baseplate has a non-slip surface for safety. A foot support is contoured for comfort. In use, the device is placed upon the bed and the user pushes with their foot against the foot support which transfers the force down the shaft of the device to the foot board, permitting a patient to adjust their position in the bed. The device can be permanently mounted or be removable therefrom the bed frame.

18 Claims, 8 Drawing Sheets

DEVICE FOR POSITIONING A USER THEREON A BED

RELATED APPLICATIONS

The present invention was first described in and claims the benefit of U.S. Provisional Application No. 61/126,731, filed May 8, 2008, the entire disclosures of which are incorporated herein by reference.

FIELD OF THE INVENTION

The present invention relates generally to patient assistance devices, and more particularly, to a device that assists in positioning and repositioning a person upon a bed.

BACKGROUND OF THE INVENTION

Devices to assist people who have physical disabilities or infirmities are well known. Many of these attempts provide a means for the user to utilize parts of the body which are not disabled to perform a desired task in place of the disabled body parts. Examples of these devices include U.S. Pat. No. 5,608,929, issued in the name of Snyder, Jr., which describes a portable device for the hand operation of a motor vehicle acceleration pedal and U.S. Pat. No. 5,542,312, issued in the name of Peters, which describes a hand control for motor vehicles.

More severely infirmed individuals are often restricted to a bed for long periods of time. Often times a bedridden person can begin to cramp due to the lack of ability to move or reposition themselves on the bed and lack the ability to performing any type of stretching or exercise in an attempt to minimize stiffness or atrophy. An example of an attempt to provide relief is U.S. Pat. No. 6,027,434, issued in the name of Gibbons, which describes a device for relieving leg cramps comprising a shaft, a handle for gripping, and a stirrup for receiving a foot of the user that provides a means to stretch the legs of the user while in the supine position in bed. Additionally, these bed-ridden patients in nursing homes, hospitals or at home, frequently have difficulty trying to position or reposition themselves upon a bed. This usually results in the patient relying on the help of others in order to reposition themselves. Patients regularly desire to be repositioned, especially those in beds with adjustable head and leg elevating means which often inadvertently move the patient into uncomfortable positions on the bed. The patient is then forced to wait for this assistance and as providing this assistance requires strength it is not always easy for a care provider to provide this help without the risk of injury. Attempts to assist bed restricted patients with movement while in bed include, U.S. Pat. No. 5,608,929, issued in the name of Crane, which describes a patient-position device comprising a sheet which is placed under the patient that is connected to rope which is also connected to a motor device and pulley system attached to the headboard which can be activated to pull the user upward to the head board and U.S. Pat. No. 6,560,794, issued in the name of Allen et al., which describes a rise assist apparatus comprising a plurality of hand grips and had rails on a frame that enables a user to control movement and regain balance while supporting themselves as they rise out of bed.

While these devices fulfill their respective, particular objectives, each of these attempts suffers from disadvantages. Accordingly, there exists a need for a means by which bedridden patients can easily reposition themselves in a bed without the help or assistance of others. The development of the present invention substantially departs from the conventional solutions and in doing so fulfills this need.

SUMMARY OF THE INVENTION

In view of the foregoing references, the inventor recognized the aforementioned inherent problems and observed that there is a need for a means for a bedridden person to reposition themselves using only their feet and legs by providing a contact structure that enables the user to push their body upward toward a headboard area without additional aid. The object of the present invention is to solve the aforementioned disadvantages.

To achieve the above objectives, it is an object of the present invention to provide a device for positioning a user upon a bed that enables a bedridden user to adjust their position in the bed without the aid of another. The device comprises two (2) insertingly joined beams, a first beam rests upon a top surface of the mattress and a second beam is secured between a mattress and footboard portions of the bed, and a foot support that provides a contact surface for a user to change position on the bed. The length is mechanically adjustable to suit individual users of all sizes and a slot and handle permit quick and easy length adjustments. A baseplate comprises a safe non-slip pad that contacts the footboard. The foot support is contoured for comfortable foot contact.

Another object of the positioning device is to provide a first beam comprising a foot support, a comfort rubber pad, a brace, and an adjustment slot.

Yet still another object of the positioning device is to provide a second beam comprising a baseplate that is rigidly attached to the second beam, a plurality of flanges and fasteners that provide the means to attach the second beam to the baseplate, a hook, an adjustment handle, and an aperture. The device is secured between the mattress and the footboard and the large area base plate provides sufficient width to remain laterally stable even when the device receives a slightly sideways force directed from the user.

Yet still another object of the positioning device is to provide a device comprising a convenient length adjusting means along an upper surface of the second beam that provides a user or caregiver an easy turn adjustment handle to loosen or tighten the length adjustment.

Yet still another object of the positioning device is to provide a device comprising an alternate baseplate assembly comprising a generally elliptical shape and a suction means to adhesively secure the device to the footboard of the bed. The suction means comprises a suction cup with manual actuator that provides a quick and simple means of removably attaching the device to the footboard.

Yet still another object of the positioning device is to provide a method of utilizing the device which allows patients who are bedridden the ability to reposition themselves in a bed with minimal or no help from others in a manner which is quick, easy and effective.

Yet still another object of the positioning device is to provide a method of utilizing the device which allows a user to push with their foot against the foot support which transfers the force down the beams of the device to the bed footboard, thereby enabling the user to adjust their position in the bed.

Further objects and advantages of the positioning device will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
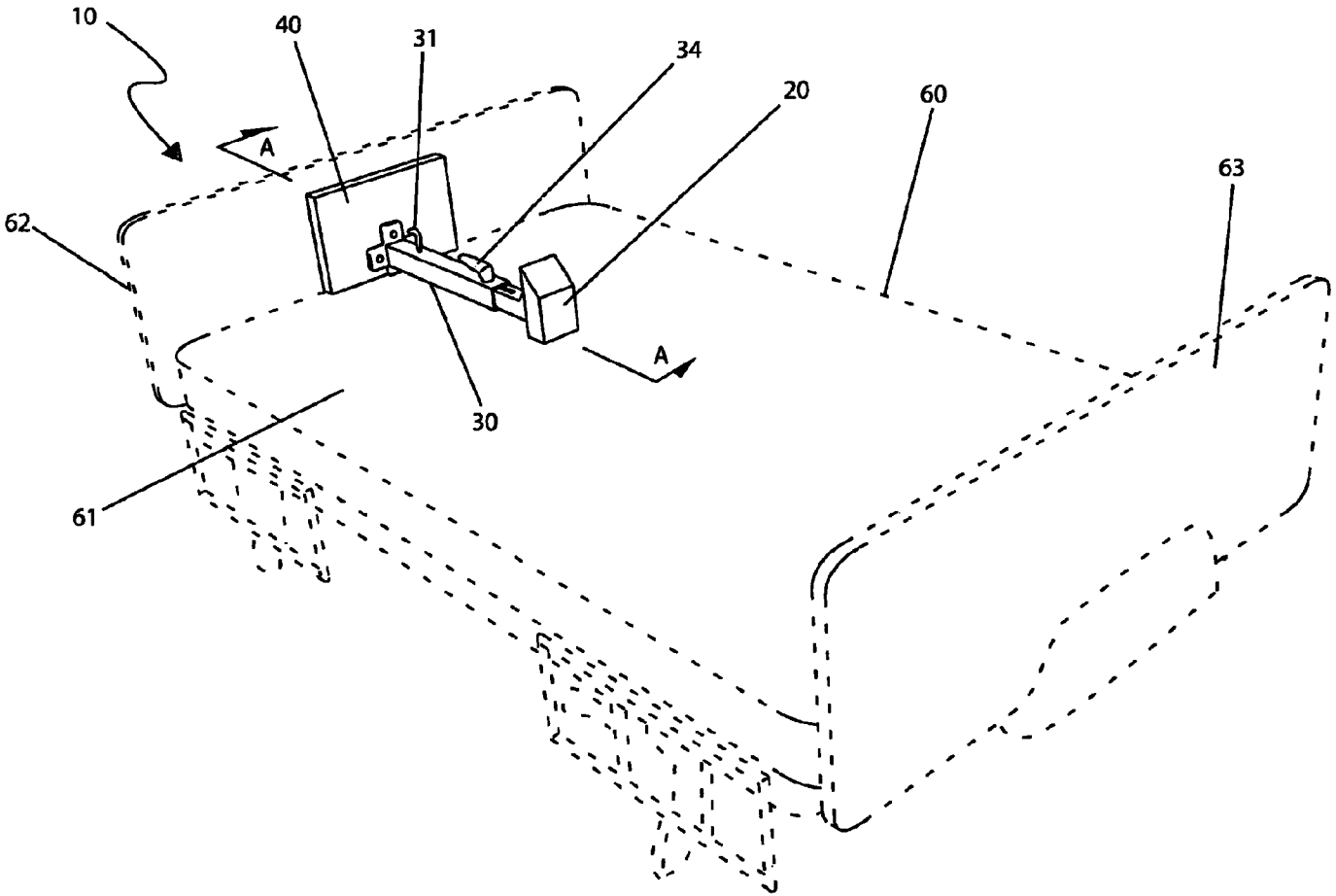
FIG. 1 is an environmental view of a device for positioning a user thereupon a bed 10, according to a preferred embodiment of the present invention.

10 device for positioning a user thereupon a bed
20 foot support
21 rubber pad
22 brace
23 first beam
24 adjustment slot
25 "T"-nut fastener
30 second beam
31 hook
32 flange
33 fastener
34 adjustment handle
35 aperture
40 baseplate
41 pad
45 alternate suction baseplate embodiment
50 alternate baseplate
51 suction cup
52 actuator
53 connection means
54 cam
60 bed
61 mattress
62 footboard
63 headboard

DETAILED DESCRIPTION OF THE PREFERRED EMBODIMENT

The best mode for carrying out the invention is presented in terms of its preferred embodiment, herein depicted within the FIGS. 1 through 8. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device for positioning a user thereupon a bed (herein described as the "device") 10, enabling a bedridden user to adjust their position in a bed 60 without additional aid. The device 10 comprises two (2) "L"-shaped joined parts having a second beam section 30 secured between mattress 61 and footboard 62 portions of the bed 60 and a first beam section 23 which is laid upon a top surface of the mattress 61 comprising a foot support 20 providing a contact surface 21 with which a user may change a position thereupon a bed 60. The overall length of the device 10 is mechanically adjustable to suit individual users of all sizes. A slot 24 and handle 34 permit quick adjustments to the length of the device 10. A baseplate 40 contacts a footboard 62 and provides a safe non-slip pad 41 thereto. A foot support 20 is contoured for comfortable foot contact. In use, the device 10 is placed upon the bed 60 and a user pushes with their foot against the foot support 20 which transfers the force down the beam 23 of the device to the bed footboard 62, permitting a user to adjust their position in the bed 60. The device 10 can be permanently mounted or removed quickly.

Figure 2:
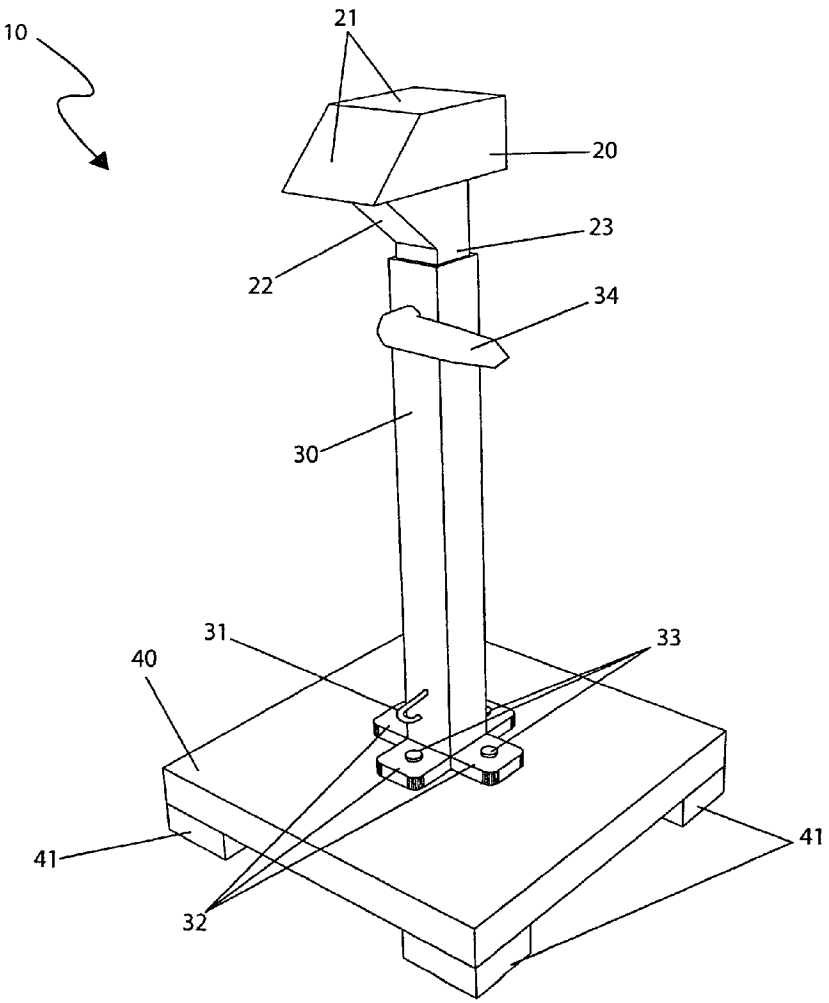
FIG. 2 is a perspective view of the device for positioning a user thereupon a bed 10, according to a preferred embodiment of the present invention.

Referring now to FIG. 1, an environmental view of the device 10 and FIG. 2 a perspective view of the device 10, according to the preferred embodiment of the present invention, are disclosed. The device 10 comprises a foot support 20, a second beam 30, an adjustment handle 34, and a baseplate 40. The device 10 is to be positioned in close proximity thereto a bedridden user's feet, thereby allowing a pushing contact to be initiated by said user subsequently repositioning the user upward toward a headboard 63 area without additional aid. The device 10 may be securely entrapped therebetween the mattress 61 and the footboard 62 and comprises a large area base plate 40 providing sufficient width so as to remain laterally stable even if the device 10 receives a slightly sideways force directed therefrom the user. The device 10 comprises a convenient length adjusting means along an upper surface of the second beam 30 providing a user or caregiver an easy quarter-turn or half-turn adjustment handle 34 to loosen or tighten. Said device 10 is easily disassembled by detaching the baseplate 40 therefrom the second beam portion 30, thereby allowing compact storage or transportation. Additionally, the device 10 may be provided with a soft or hard carrying case, thereby increasing ease of portability for nurses making house calls, for example. The device 10 is illustrated in FIG. 1 as being applied to a hospital-type bed; however, it is understood that the device 10 may also be used in conjunction with other type beds in both institution and home settings.

Figure 3:
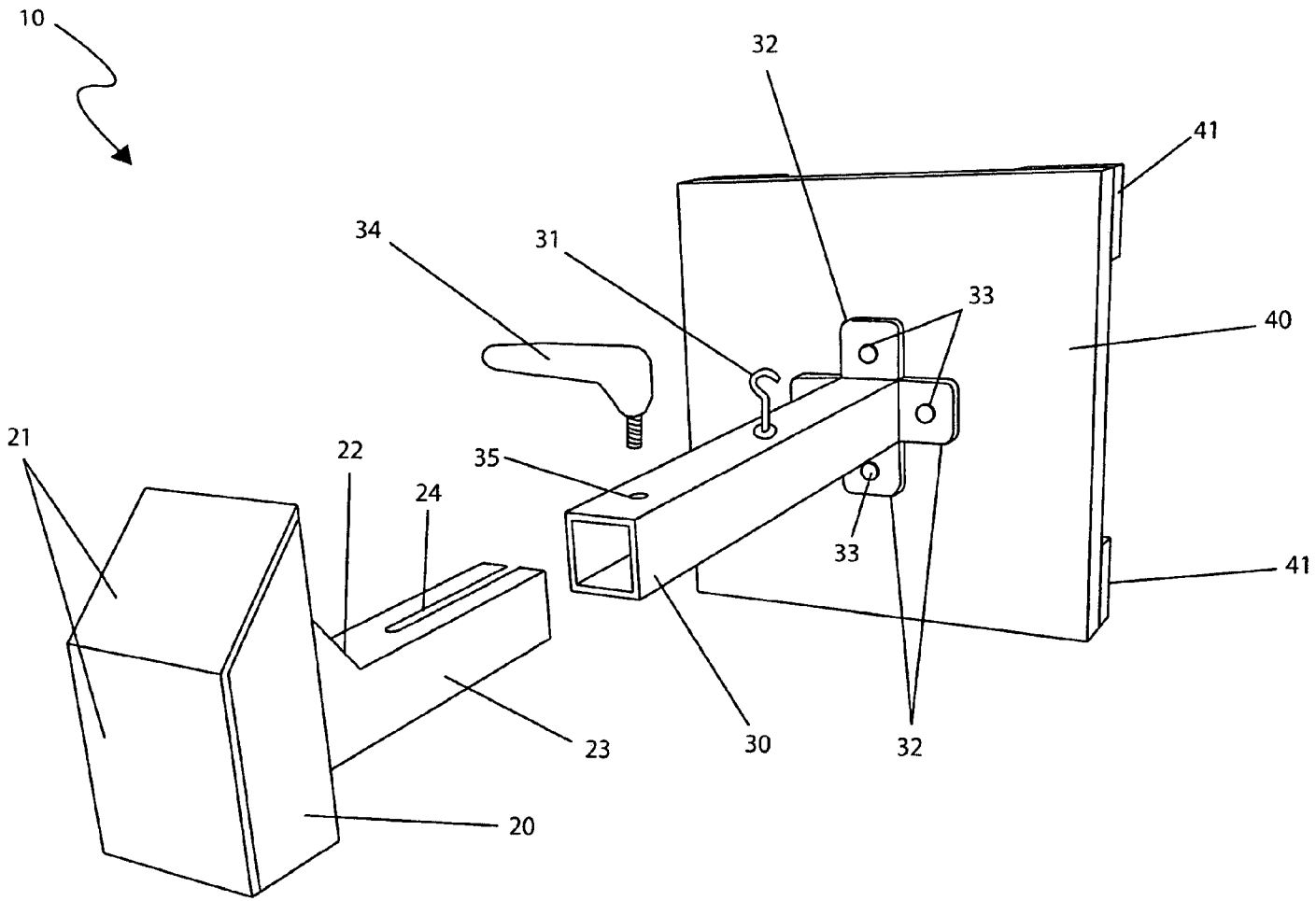
FIG. 3 is a partially exploded view of the device for positioning a user thereupon a bed 10, according to a preferred embodiment of the present invention.
Figure 4:
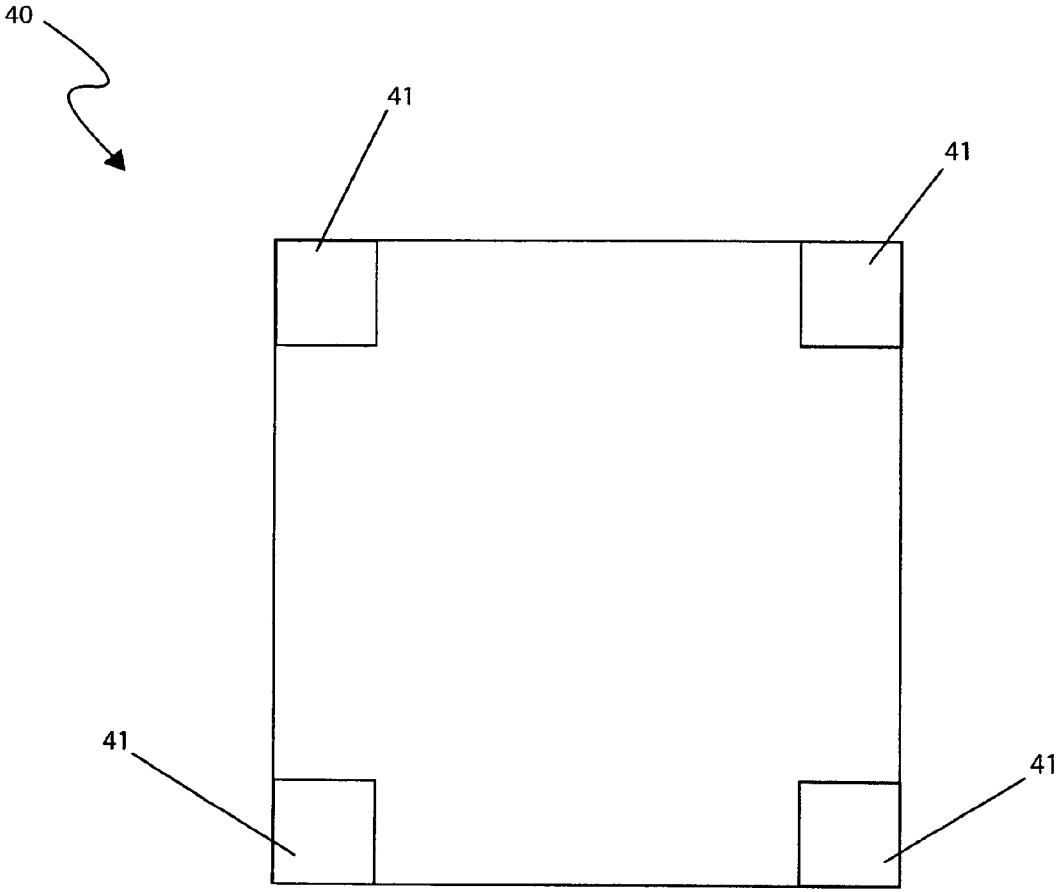
FIG. 4 is a rear view of a baseplate portion 40, according to a preferred embodiment of the present invention.
Figure 5:
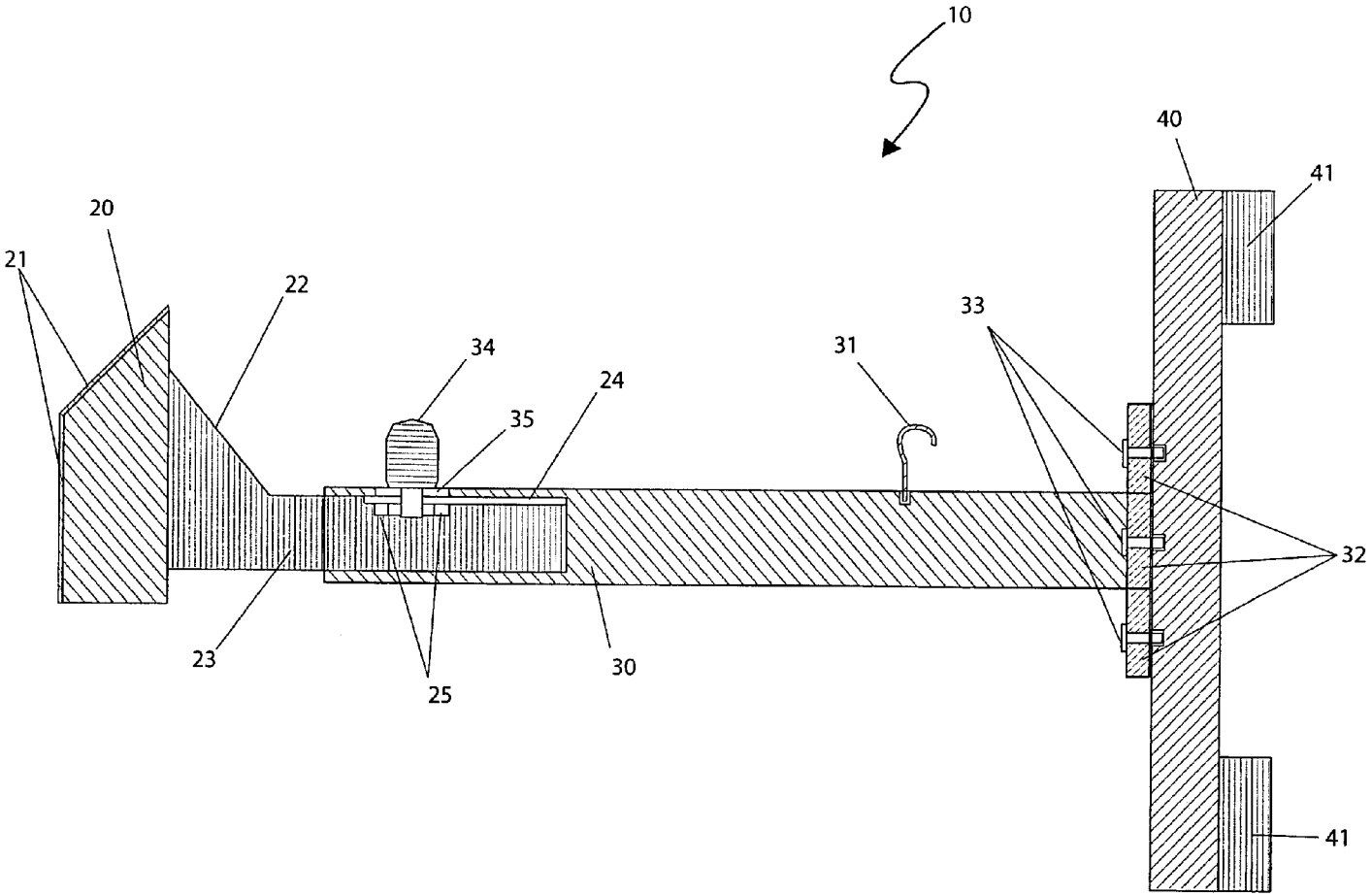
FIG. 5 is a cross-sectional view of the device for positioning a user thereupon a bed 10 taken along section lines A-A shown on FIG. 1, according to a preferred embodiment of the present invention.

Referring now to FIGS. 3 through 5, various views of the device 10, according to the preferred embodiment of the present invention, are disclosed. The device 10 comprises a foot support 20, a first beam 23, an adjustment slot 24, a second beam 30, a hook 31, an adjustment handle 34, four (4) mounting flanges 32, a plurality of fasteners 33, and a baseplate 40. The device 10 is fabricated using an assembly of lightweight components using materials such as, but not limited to: square aluminum tubing, welded aluminum plates, molded carbon fibers, fiberglass shapes, or the like providing easy lifting and transport of the device by a user or caregiver.

The foot support 20 provides a comfortable angled contact surface thereto a user's foot during use. The foot support 20 comprises a lightweight generally rectangular structure approximately six (6) inches in height which comprises a proximal surface having a lower vertical and an upper angled surface so as to match anticipated foot contact angles as a user applies a force thereto. The foot support 20 further comprises a rubber pad 21 along said proximal surface and an integral bracing feature 22 formed along a distal region of the foot support 20. The rubber pad 21 provides a comfortable contact surface thereto a user's bare foot and is fabricated from a soft padded material such as, but not exclusively: rubber, urethane, fabrics, or the like. The brace 22 provides structural strength therebetween the foot support 20 and an attached first beam portion 23. The foot support 20 provides a permanent attachment means thereto the first beam 23 via a welded or molded connection.

The first beam 23 comprises a rugged horizontal member approximately eighteen (18) inches long and fabricated from lightweight rectangular hollow tubing. The first beam 23 comprises particular outside dimensions being slidingly inserted therein a corresponding proximal end of the rectangular second beam 30 forming a length adjustable and telescoping motion therebetween. Said first beam 23 also comprises an adjustment slot 24, thereby providing an adjustable attachment means to a second beam 30. The adjustment slot 24 is located thereon a horizontal top portion of the first beam 23 and takes the form of an elongated circular aperture, thereby enabling an adjustment handle to be inserted therein and adjusted to a desired position.

The adjustment handle 34 comprises a common "L"-shaped threaded fixture. The adjustment handle 34 is illustrated here working in conjunction therewith the adjustment slot 24 portion of the first beam 23 and a standard internal "T"-nut type fastener 25 to provide a length adjustment means via a high-friction clamping of respective mating surfaces in an expected manner. However, it is understood that other clamping and fastening fixtures may be provided such as cams, spring release pins, bolts, or the like, without deviating from the concept and as such should not be interpreted as a limiting factor of the invention 10.

The second beam 30 comprises horizontal rectangular tubing approximately twelve (12) inches long providing a particular inner rectangular shape so as to slidingly receive the first beam portion 23 therein. The second beam 30 is fabricated from a similar lightweight material as the first beam 23. A top horizontal portion of the second beam 30 comprises an aperture 35, thereby enabling insertion of the abovementioned handle 34. The second beam 30 also comprises four (4) flanges 32 along a distal end thereof which extend outwardly therefrom each outer surface of said second beam 30 in a perpendicular direction providing omni-directional stability thereto the device 10. Said flanges 32 provide an attachment means thereto a proximal surface of the baseplate 40 via respective fasteners 33. The fasteners 33 are provide quick and convenient disassembly of the device for storage or transportation of the device 10 using components such as knurled or pronged knobs.

The second beam 30 also provides an attachment means thereto a hook 31 permanently mounted therealong a top horizontal surface at an intermediate position. The hook 31 provides a means to affix various devices such as flexible straps, bungee-based exercise devices, and the like, which may aid a user's ability to change their position or participate in desired exercises while in the bed 60.

The baseplate 40 comprises a rectangular-shaped flat plate approximately twelve (12) to twenty-four (24) inches along a perimeter edge being approximately one-quarter (¼) to one-half (½) inch thick. The baseplate 40 further comprises four (4) scratch-resistant pads along a distal surface thereof providing a soft and protective contact thereto a footboard portion 62. The pads 41 are affixed thereto said baseplate 40 using fastening means such as adhesives, screws, nails, staples, or the like. The baseplate 40 is depicted here having four (4) rectangular pad elements 41; however, any number of pad elements 41 may be provided covering a part or all of a distal surface of the baseplate 40.

Figure 6:
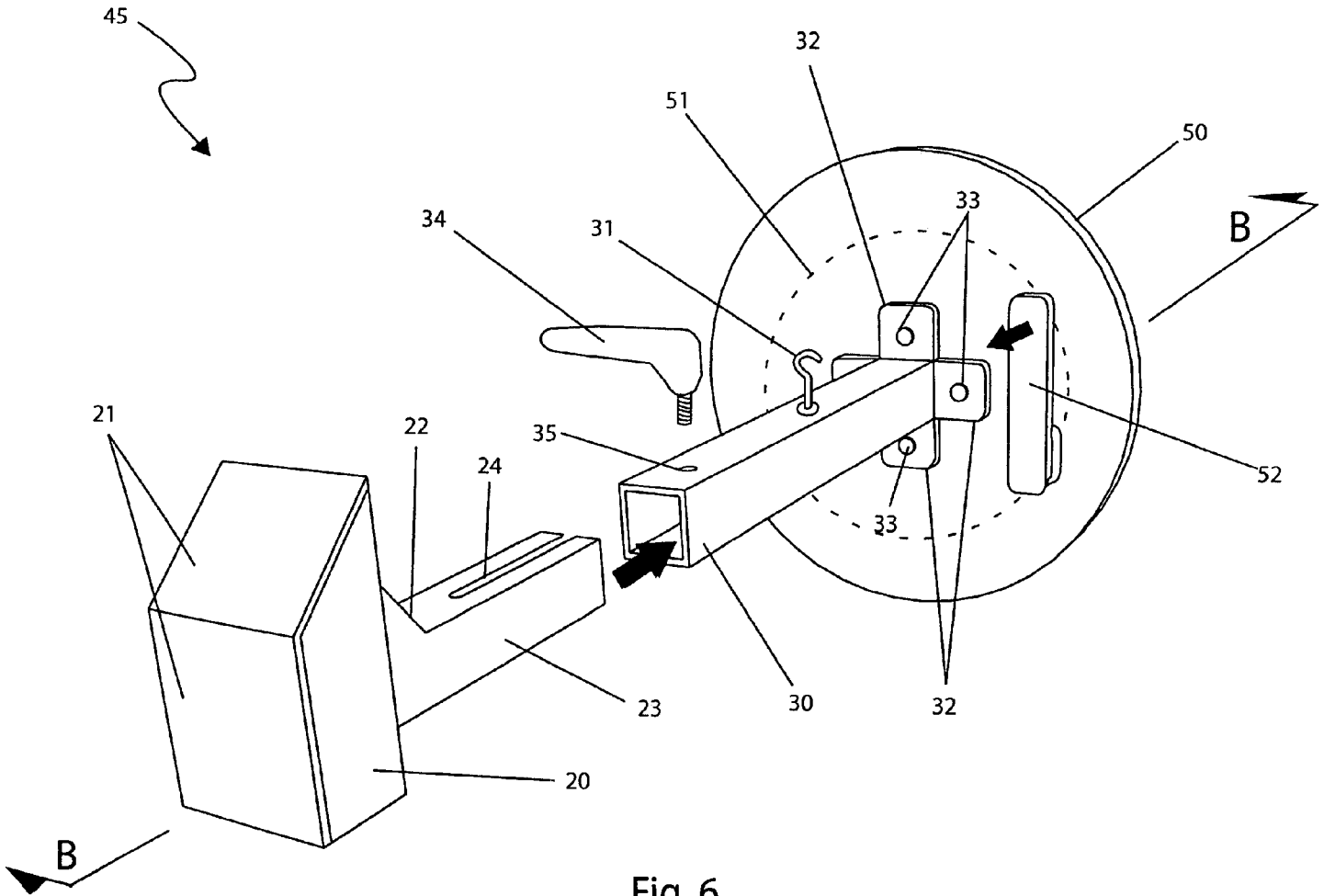
FIG. 6 is a perspective view of an alternate suction baseplate attachment embodiment 45, according to an alternate embodiment of the present invention.
Figure 7:
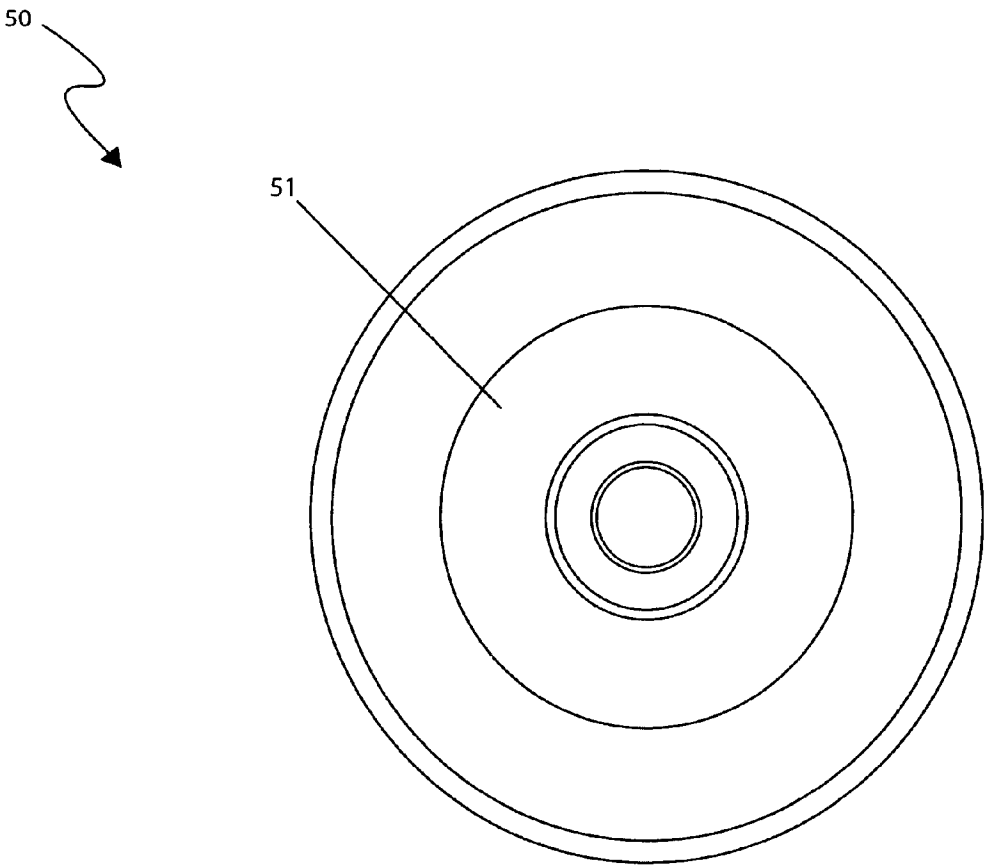
FIG. 7 is a rear view of an alternate baseplate portion 50, according to an alternate embodiment of the present invention; and, FIG. 8 is a cross-sectional view of the alternate suction baseplate attachment embodiment 45 taken along section lines B-B shown on FIG. 6, according to an alternate embodiment of the present invention.
Figure 8:
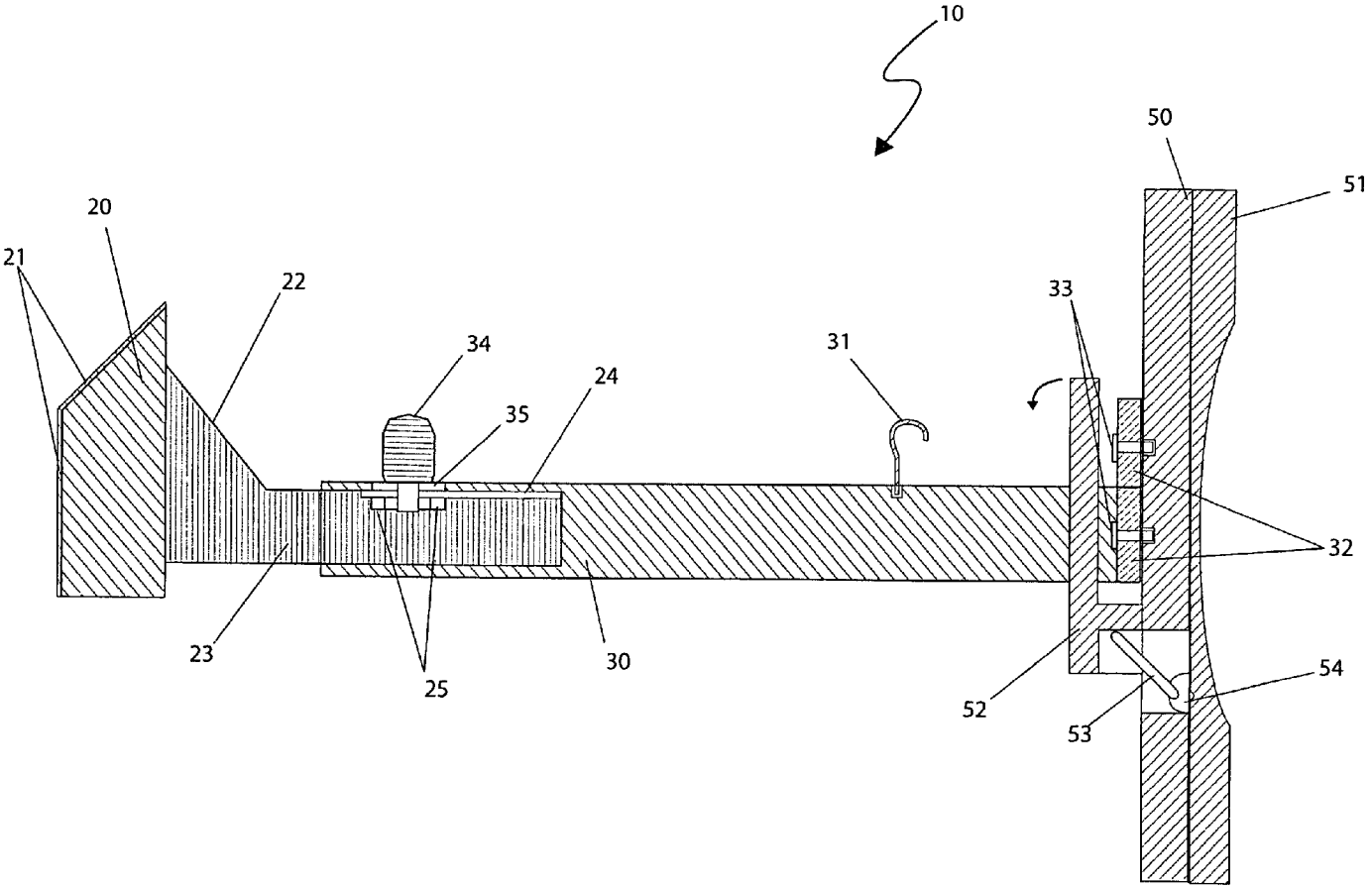

Referring now to FIGS. 6 through 8, various views of the alternate baseplate attachment embodiment 45 of the present invention, are disclosed. The alternate baseplate attachment embodiment 45 is illustrated here comprising a round or elliptical alternate baseplate 50 approximately twelve (12) inches in diameter and utilizing an included suction means to obtain a secure adherence thereto a bed footboard 62. The alternate baseplate 50 comprises an attachment means thereto the second beam portion 30 in like manner as the preferred rectangular baseplate 40 and is to be made using similar materials. The alternate baseplate 50 comprises sufficient diameter so as to provide ample side-to-side stability to the device 10 during use.

The alternate baseplate 50 further comprises a suction cup 51 and a manual actuator 52. The suction cup 51 comprises a large circular rubber cup or bladder-type structure approximately six (6) to ten (10) inches in diameter forming a vacuum seal thereto a smooth vertical surface along a footboard 62, thereby providing quick installation and disassembly of the alternate baseplate attachment embodiment 45 thereto a bed 60. The suction cup 51 provides a sturdy sealed annular attachment along a perimeter edge thereto the alternate baseplate 50 using common fastening means such as adhesives, rivets, screws, or the like. The actuator 52 comprises a connection means 53 and cam 54, thereby providing a common manual two-position cam lever designed to increase an internal air volume of the suction cup 51 when folded down against the alternate baseplate 50.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: assembling the baseplate 40 thereto the second beam 30 using the flanges 32 and respective fastening means 33; inserting the first beam portion 23 telescopingly thereinto the second beam portion 30; securing a desired fixed length of the device 10 using the adjustment handle 34 and tightening via rotating the adjustment handle 34 to tighten the T-nut 25; sliding the baseplate 40 vertically downward therebetween mattress 61 and footboard 62 portions of a bed 60; allowing a user to occupy the bed 60 in a normal manner; encouraging said user to press their foot thereagainst the foot support 20 to reposition themselves as needed; utilizing the hook 31 to obtain further mobility by a user or to enable said user to participate in various exercises; extracting the device 10 therefrom the bed 60; disassembling the device into two (2) or three (3) main parts using the fasteners 33 and adjustment handle 34; storing or transporting the device 10 as desired; and, benefiting from increased mobility of a user therewithin a bed 60 when using the present invention 10.

The method of utilizing the alternate baseplate attachment embodiment 45 may be accomplished by the following additional steps: attaching the alternate baseplate 50 thereto the second beam 30 using the provided fasteners 33; manually pivoting the actuator 52 to a perpendicular orientation with respect thereto the proximal surface of the alternate baseplate 50; holding the alternate baseplate 50 vertically against a smooth footboard surface 62 establishing a seal therebetween said footboard 62 and the suction cup portion 51; pivoting the actuator 52 thereagainst the proximal surface of the baseplate 50 to establish an internal vacuum within the suction cup 51; and, utilizing the alternate suction embodiment 45 in a similar manner as the preferred embodiment 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A positioning device for positioning a user thereupon a bed further comprising:

a first beam section comprising a resilient rectangular tubing body further comprising:

a first beam proximal end further comprising a foot support section; and, a first beam distal end slidably engaging a second beam section;

said foot support section comprising an integral portion thereof said first beam section, further comprising a generally rectangular structure having a first end comprising a lower vertical surface and an upper angled surface, and a second end affixed thereto said first beam section having a bracing feature;

said second beam section slidably receiving said first beam section;

a length adjustment means for securing said first beam section thereto said second beam section thereat a desired length; and, a baseplate attached thereto said second beam section therewith a baseplate attachment means;

wherein said positioning device provides a positioning means permitting said user to adjust their position in said bed;

wherein said first beam section is slidably adjustable therein said second beam section;

wherein said foot support section provides a contact surface and a support means therefor said user;

wherein said upper angled surface provides said contact surface and said support means for a foot of said user;

wherein said bracing feature provides structural strength therebetween said foot support section and said first beam section; and, wherein said baseplate contacts a footboard thereof said bed to provide a bracing and stabilizing means.

2. The positioning device of claim 1, wherein said first beam section further comprises a length of approximately eighteen (18) inches.

3. The positioning device of claim 1, further comprising a rubber pad bonded thereto said first end.

4. The positioning device of claim 1, wherein said second beam section comprises a resilient rectangular tubing body providing an inner portion for slidingly receiving said first beam section therein, further comprising:

a second beam proximal end receiving said first beam distal end; and, a second beam distal end comprising four (4) flanges each perpendicularly extending outwardly therefrom said second beam section and attached thereto said baseplate therewith said baseplate attachment means;

wherein said four (4) flanges provide an omni-directional stabilizing means therefor said positioning device.

5. The positioning device of claim 4, further comprising a hook mounted therealong a top horizontal surface at an intermediate position;

wherein said hook provides an attachment means therefor additional devices providing an additional positioning means; and, wherein said hook provides an attachment means therefor additional devices providing an exercising means.

6. The positioning device of claim 1, wherein said second beam section further comprises a length of approximately twelve (12) inches.

7. The positioning device of claim 4, wherein said length adjustment means further comprises:

an adjustment slot located on an upper surface thereof said first beam section longitudinally extending therefrom said first beam distal end to an intermediate location;

an aperture located thereon an upper surface thereof said second beam section adjacent thereto said second beam proximal end;

an adjustment handle, comprising an "L"-shaped threaded fixture threadably engaged therewith said aperture; and, a fastener threadably engaged therewith said adjustment handle;

wherein said adjustment handle passes through said aperture and said adjustment slot and secures said first beam section relative to said second beam section thereat said desired length therewith said fastener.

8. The positioning device of claim 4, wherein said baseplate comprises a rectangular-shaped plate further comprising:

a baseplate proximal end affixed thereto said four (4) flanges thereof said second beam distal end; and, a baseplate distal end comprising a plurality of scratch-resistant pads affixed thereto a distal surface thereof;

wherein said plurality of scratch-resistant pads provides a soft and protective contact thereto said footboard.

9. The positioning device of claim 8, wherein said baseplate further comprises dimension of approximately twelve (12) to twenty-four (24) inches along a perimeter edge and a thickness approximately one-quarter (¼) to one-half (½) inch.

10. The positioning device of claim 9, wherein said baseplate comprises a circular-shaped plate further comprising:

a baseplate proximal end affixed thereto said four (4) flanges thereof said second beam distal end;

a baseplate distal end comprising a plurality of scratch-resistant pads affixed thereto a distal surface thereof; and, a manually actuated suction means centrally located thereat said baseplate distal end;

wherein said plurality of scratch-resistant pads provides a soft and protective contact thereto said footboard;

wherein said suction means provides an additional bracing and stabilizing means therefor said positioning device thereto said footboard.

11. The positioning means of claim 10, wherein said suction means further comprises:

a suction cup comprising a large circular rubber cup or bladder-type structure affixed thereto said baseplate distal end; and, an actuator comprising a manual two-position cam lever designed to increase an internal air volume of said suction cup when folded down against said baseplate;

wherein said suction cup provides a vacuum seal thereto said footboard.

12. The positioning device of claim 11, wherein said baseplate further comprises a diameter of approximately twelve (12) inches, a thickness approximately one-quarter (¼) to one-half (½) inch, and said suction pad comprises a diameter of approximately six (6) to ten (10) inches.

13. A method of positioning a user thereon a bed therewith a positioning aid comprises the following steps:

providing said positioning aid further comprising:

a first beam section comprising a resilient rectangular tubing body and further comprising a first beam proximal end, and a first beam distal end;

a foot support section comprising a generally rectangular structure having a first end with a rubber pad bonded thereto, comprising a lower vertical surface and an upper angled surface, and a second end affixed thereto said first beam section having a bracing feature;

a second beam section comprising a resilient rectangular tubing body providing an inner portion for slidingly receiving said first beam section therein, further comprising a second beam proximal end receiving said first beam distal end, a second beam distal end comprising four (4) flanges each perpendicularly extending outwardly therefrom said second beam section, and a hook mounted therealong a top horizontal surface at an intermediate position;

a length adjustment means for securing said first beam section thereto said second beam section thereat a desired length, further comprising an adjustment slot located on an upper surface thereof said first beam section longitudinally extending therefrom said first beam distal end to an intermediate location, an aperture located thereon an upper surface thereof said second beam section adjacent thereto said second beam proximal end, an adjustment handle comprising an "L"-shaped threaded fixture threadably engaged therewith said aperture, and, a fastener threadably engaged therewith said adjustment handle; and, a baseplate comprising a rectangular-shaped plate further comprising a baseplate proximal end affixed thereto said four (4) flanges thereof said second beam distal end, and a baseplate distal end comprising a plurality of scratch-resistant pads affixed thereto a distal surface thereof;

attaching said baseplate thereto said second beam section therewith a fastening means;

inserting said first beam section telescopingly thereinto said second beam portion, ensuring that said adjustment slot is aligned therewith said aperture;

securing said desired length using said adjustment handle and said fastener;

sliding said baseplate vertically downward therebetween a mattress and a footboard of said bed;

allowing said user to occupy said bed;

pressing a foot thereof said user thereagainst said foot support section to provide a positioning means, wherein said foot of said user contacts said rubber pad to provide a comfortable contact therewith; and, removing and disassembling said positioning aid.

14. The method of claim 13, further comprising the step of:

utilizing said hook to provide an attachment means therefor an additional device to provide additional positioning means therefor said user.

15. The method of claim 13, further comprising the step of:

utilizing said hook to provide an attachment means therefor an additional device to provide an exercising means therefor said user.

16. A method of positioning a user thereon a bed therewith a positioning aid comprises the following steps:

providing said positioning aid further comprising:

a first beam section comprising a resilient rectangular tubing body and further comprising a first beam proximal end, and a first beam distal end;

a foot support section comprising a generally rectangular structure having a first end with a rubber pad bonded thereto, comprising a lower vertical surface and an upper angled surface, and a second end affixed thereto said first beam section having a bracing feature;

a second beam section comprising a resilient rectangular tubing body providing an inner portion for slidingly receiving said first beam section therein, further comprising a second beam proximal end receiving said first beam distal end, a second beam distal end comprising four (4) flanges each perpendicularly extending outwardly therefrom said second beam section, and a hook mounted therealong a top horizontal surface at an intermediate position;

a length adjustment means for securing said first beam section thereto said second beam section thereat a desired length, further comprising an adjustment slot located on an upper surface thereof said first beam section longitudinally extending therefrom said first beam distal end to an intermediate location, an aperture located thereon an upper surface thereof said second beam section adjacent thereto said second beam proximal end, an adjustment handle comprising an "L"-shaped threaded fixture threadably engaged therewith said aperture, and, a fastener threadably engaged therewith said adjustment handle; and, a baseplate comprises a circular-shaped plate further comprising a baseplate proximal end affixed thereto said four (4) flanges thereof said second beam distal end, a baseplate distal end comprising a plurality of scratch-resistant pads affixed thereto a distal surface thereof, and a manually actuated suction means centrally located thereat said baseplate distal end, comprising a suction cup affixed thereto said baseplate distal end and an actuator comprising a manual two-position cam lever designed to increase an internal air volume of said suction cup when folded down against said baseplate;

attaching said baseplate thereto said second beam section therewith a fastening means;

inserting said first beam section telescopingly thereinto said second beam portion, ensuring that said adjustment slot is aligned therewith said aperture;

securing said desired length using said adjustment handle and said fastener;

sliding said baseplate vertically downward therebetween a mattress and a footboard of said bed;

manually pivoting said actuator to a perpendicular orientation with respect thereto said baseplate proximal end;

holding said baseplate vertically against said footboard, thereby establishing a seal therebetween said footboard and said suction cup;

pivoting said actuator thereagainst said baseplate proximal end to establish an internal vacuum therewithin said suction cup, thereby providing an additional stabilizing means therefor said positioning aid;

allowing said user to occupy said bed;

pressing a foot thereof said user thereagainst said foot support section to provide a positioning means, wherein said foot of said user contacts said rubber pad to provide a comfortable contact therewith; and, removing and disassembling said positioning aid.

17. The method of claim 15, further comprising the step of:

utilizing said hook to provide an attachment means therefor an additional device to provide additional positioning means therefor said user.

18. The method of claim 15, further comprising the step of:

utilizing said hook to provide an attachment means therefor an additional device to provide an exercising means therefor said user.

* * * * *